US005313553A

United States Patent [19]

Laurent

[11] Patent Number: 5,313,553

[45] Date of Patent: May 17, 1994

[54] METHOD TO EVALUATE THE PITCH AND VOICING OF THE SPEECH SIGNAL IN VOCODERS WITH VERY SLOW BIT RATES

[75] Inventor: Pierre-André Laurent, Bessancourt, France

[73] Assignee: Thomson-CSF, Puteaux, France

[21] Appl. No.: 802,621

[22] Filed: Dec. 5, 1991

[30] Foreign Application Priority Data

Dec. 11, 1990 [FR] France ..... 90 15477

[51] Int. Cl.[5] ..... G10L 9/08

[52] U.S. Cl. ..... 395/2.16; 381/49

[58] Field of Search ..... 395/2; 381/49

[56] References Cited

U.S. PATENT DOCUMENTS

| | | | |
|---|---|---|---|
| 3,603,738 | 9/1971 | Focht | 381/49 |
| 4,015,088 | 3/1977 | Dubnowski et al. | 381/49 |
| 4,653,098 | 3/1987 | Nakata et al. | 381/49 |

FOREIGN PATENT DOCUMENTS

| | | |
|---|---|---|
| 0125423 | 11/1984 | European Pat. Off. . |
| 0345675 | 12/1989 | European Pat. Off. . |
| 2145501 | 2/1973 | France . |
| 2321738 | 3/1977 | France . |

OTHER PUBLICATIONS

L. Rabiner, et al., "Digital Processing of Speech Signals", 1978, pp. 141–158, 433–435, & 446–450.

IEEE Journal of Solid-State Circuits, vol. SC-22, No. 3, Jun. 1987, pp. 479–487, S. S. Pope, et al., "A Single--Chip Linear-Predictive-Coding Vocoder".

IEEE, International Conference on Acoustics, Speech, and Signal Processing, vol. 1, Apr. 7–11, 1986, pp.121–124, W. Verhelst, et al., "An Adaptive Non-Uniform Sign Clipping Preprocessor (ANUSC) for Real-Time Autocorrelative Pitch Detection".

IEEE, International Conference on Acoustics, Speech, and Signal Processing, vol. 1, Mar. 26–29, 1985, pp. 403–406, S. Y. Kwon, et al., "A Robust Realtime Pitch Extraction from the ACF of LPC Residual Error Signals".

IEEE Transactions on Acoustics, Speech, and Signal Processing, vol. ASSP-24, No. 5, Oct. 1976, pp. 399–418, L. R. Rabiner, et al., "A Comparative Performance Study of Several Pitch Detection Algorithms".

*Primary Examiner*—Michael R. Fleming
*Assistant Examiner*—Richard Kim
*Attorney, Agent, or Firm*—Oblon, Spivak, McClelland, Maier & Neustadt

[57] ABSTRACT

The disclosed method consists of: the cutting up, after sampling, of the speech signal into frames of a determined duration; the carrying out a first self-adaptive filtering of the sampled signal (Sn) obtained in each frame to limit the influence of the first formant; the carrying out a second filtering to keep only a minimum of harmonics of the fundamental frequency; and the comparing of the signal obtained with two adaptive thresholds SfMin(n) and SfMax(n), respectively positive and negative and changing as a function of time according to a predetermined relationship so as to choose only the signal portions that are respectively above or below the two thresholds. It then consists of: the computation, on a predetermined number of fundamental frequencies or pitches M possible, of the self-correlation of the signal obtained at the end of the previous processing operation from a determined sampling instant No; the choosing, as candidate pitch M or fundamental frequency values, those that are equal in number to a predetermined number n corresponding to maxima of self-correlation; and the entering of the corresponding values of the self-correlation in a table of scores updated at each new self-correlation so as to choose, as a pitch value, only the value that corresponds to a maximum score.

5 Claims, 4 Drawing Sheets

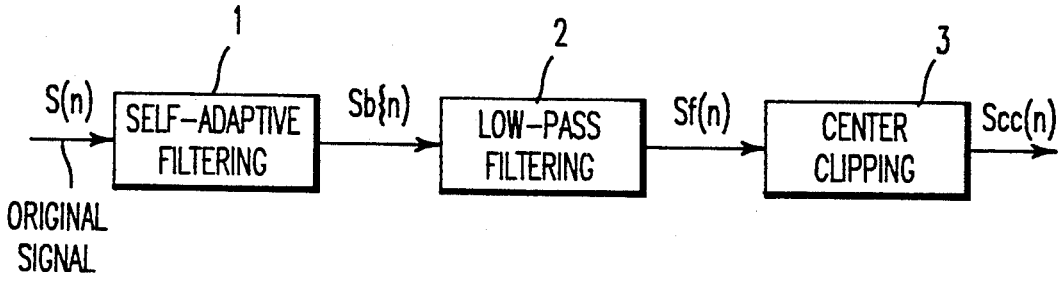
FIG. 1
FIG. 2a
FIG. 2b
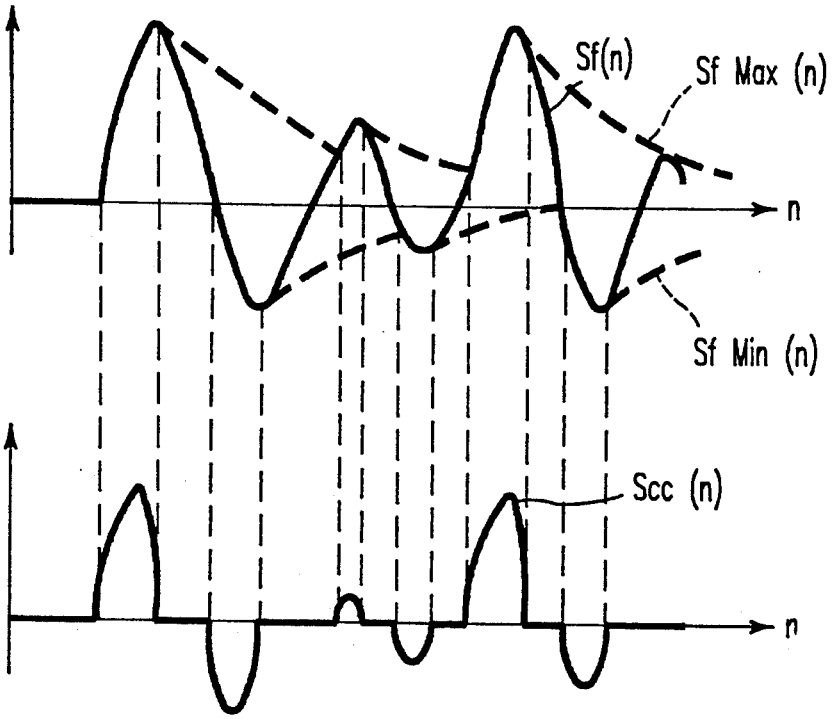

METHOD TO EVALUATE THE PITCH AND VOICING OF THE SPEECH SIGNAL IN VOCODERS WITH VERY SLOW BIT RATES

BACKGROUND OF THE INVENTION

The present invention relates to a method for evaluating the pitch and voicing of the speech signal in vocoders with very low bit rates.

In known vocoders with low bit rates, the speech signal is cut up into 20 ms and 30 ms frames so that the periodicity or pitch of the speed signal can be determined within these frames. However, during the transitions, this period is not stable and errors occur in the estimation of the pitch and, consequently, in the estimation of the voicing in these parts. Besides, if the speech signal is highly noise-affected by the ambient noise, the evaluation of the pitch is then highly disturbed or even erroneous.

SUMMARY OF THE INVENTION

The aim of the invention is to overcome the above-mentioned drawbacks.

To this effect, an object of the invention is a method to evaluate the pitch and voicing of the speech signal in vocoders with very low bit rates, wherein there is carried out a first processing operation consisting of:

- the cutting up, after sampling, of the signal into frames of a determined duration,
- the carrying out a first self-adaptive filtering of the sampled signal (Sn) obtained in each frame to limit the influence of the first formant,
- the carrying out a second filtering to keep only a minimum of harmonics of the fundamental frequency,
- and the comparing of the signal obtained with two adaptive thresholds SfMin(n) and SfMax(n), respectively positive and negative and changing as a function of time according to a predetermined relationship so as to choose only the signal portions that are respectively above or below the two thresholds; and wherein there is carried out a second processing operation on the signal Scc(n) obtained at the end of the first processing operation, said second processing operation consisting of:
- the computation, on a predetermined number of fundamental frequencies or pitches M possible, of the self-correlation of the signal obtained at the end of the first processing operation from a determined sampling instant No and
- the choosing, as candidate pitch M or fundamental frequency values, those that are equal in number to a predetermined number n corresponding to maxima of self-correlation and
- the entering of the corresponding values of the self-correlation in a table of scores updated at each new self-correlation so as to choose, as a pitch value, only the value that corresponds to a maximum score.

BRIEF DESCRIPTION OF THE DRAWINGS

Other features and advantages of the invention shall appear here below from the following description, made with reference to the appended drawings, of which:

FIG. 1 is a flow chart representing an operation for the pre-processing of the speech signal implemented by the invention;

Figure 3:
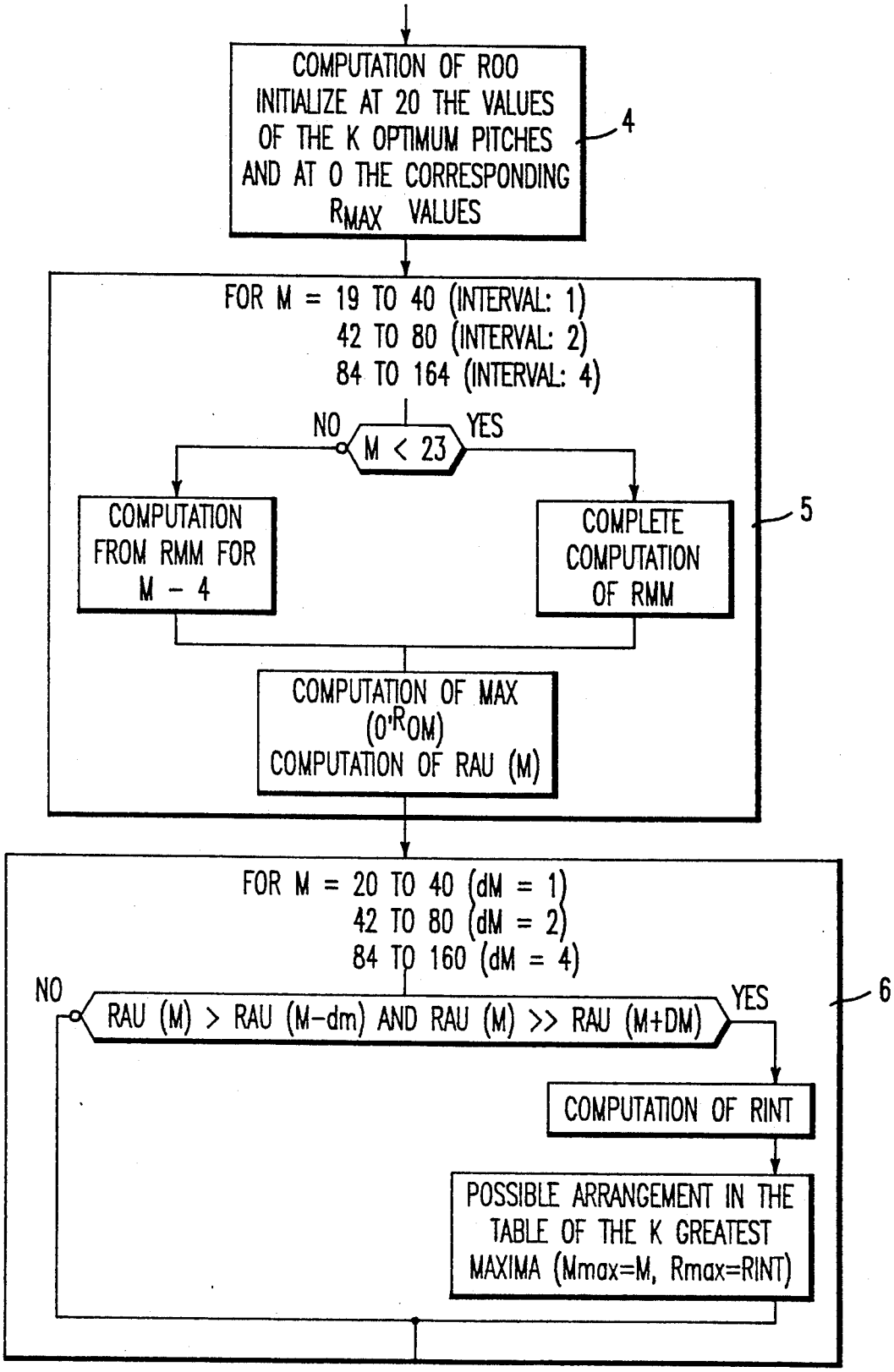
Figure 4:
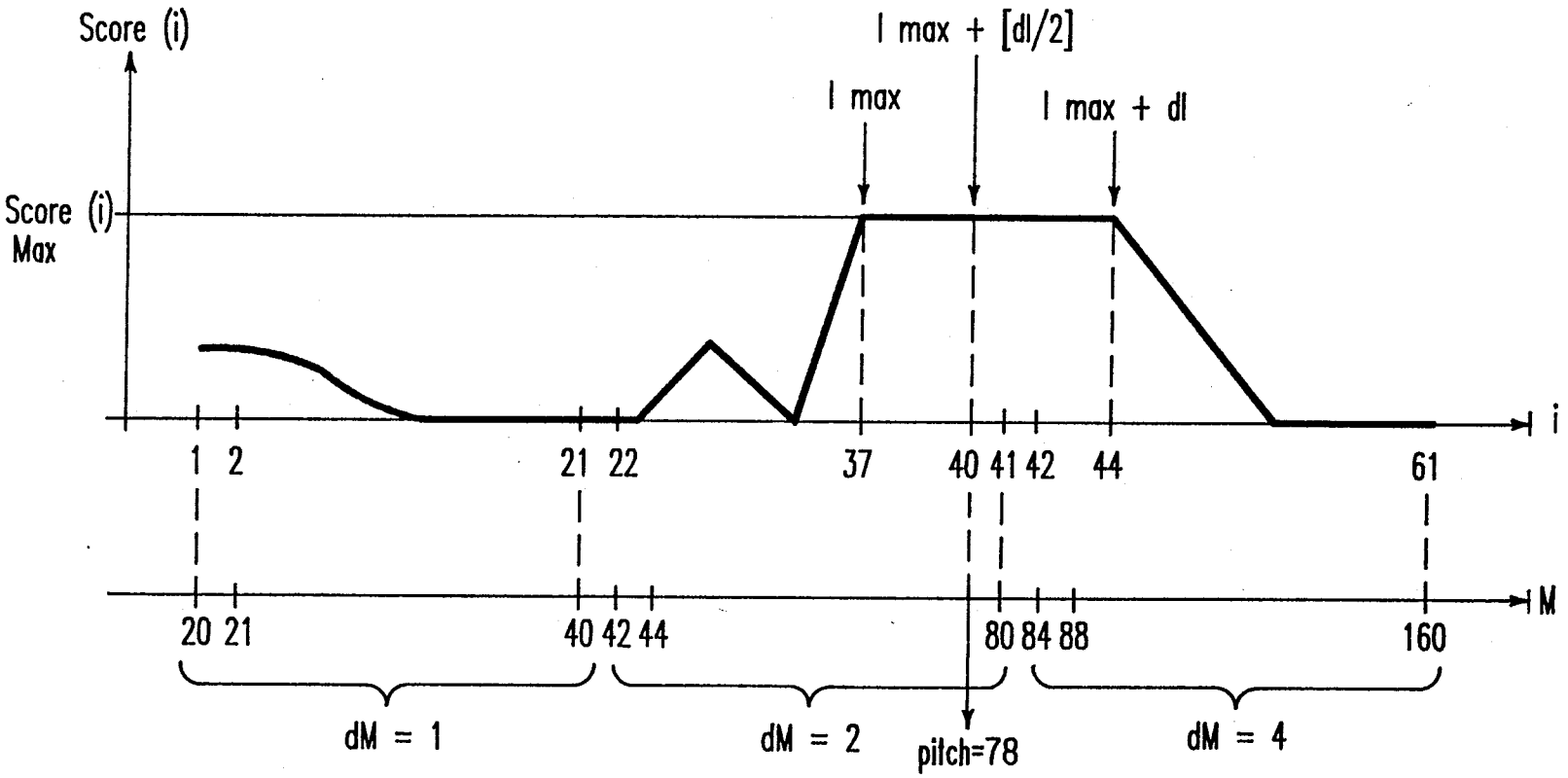
Figure 5:
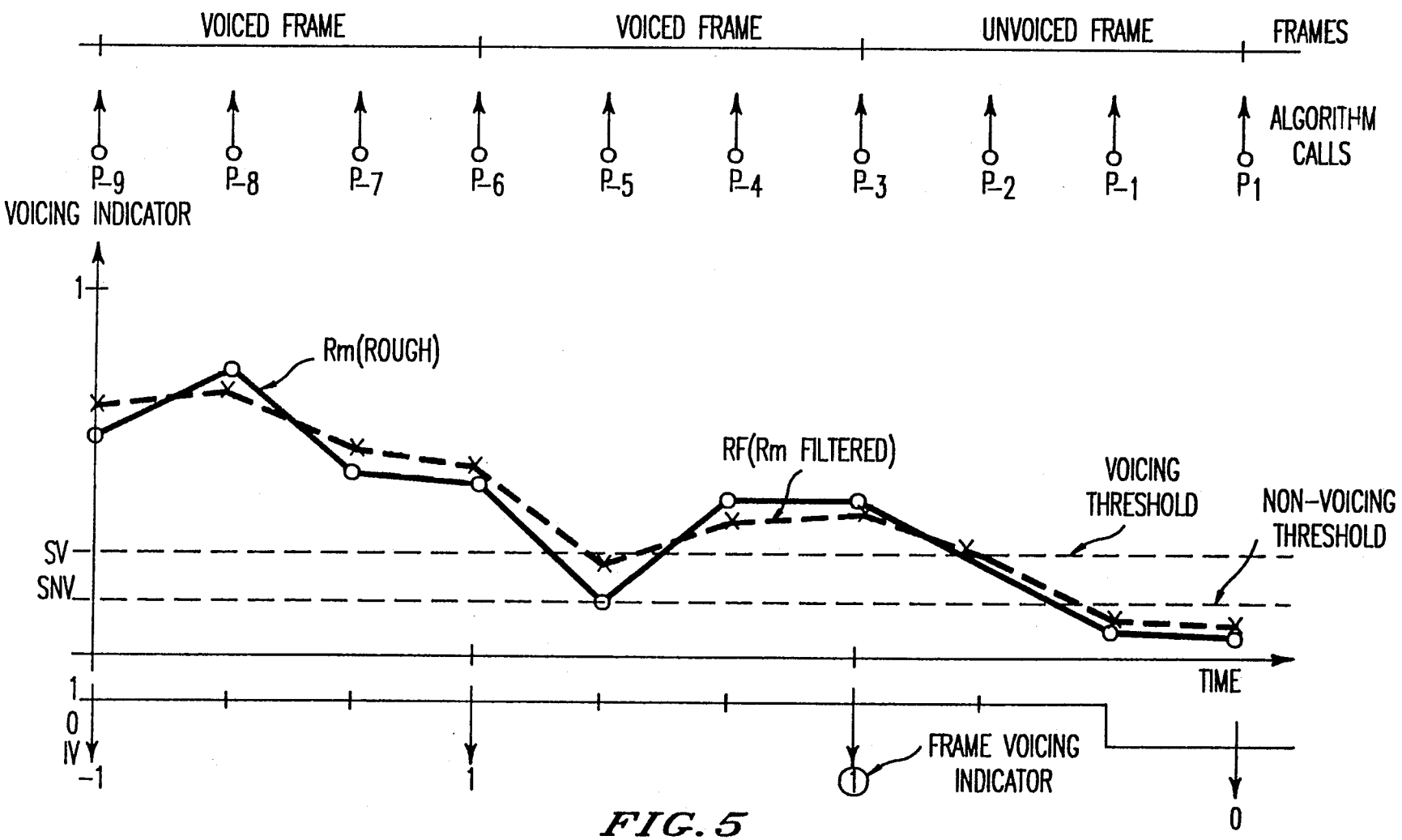

FIGS. *2a–2b* shows examples of the development of the filtered signal and of the final signal obtained at the end of the preprocessing line of FIG. 1;

FIG. 3 is a flow chart for the computation of K candidate values for the determination of the pitch according to the invention;

FIG. 4 is a graph used to illustrate a mode of determining the pitch from a table of coefficients representing different possible pitch values;

FIG. 5 is a graph illustrating the working of a voicing indicator.

DESCRIPTION OF THE INVENTION

The principle of the invention consists in making, in a given frame, several estimates of the pitch at regular intervals and in paying special attention to the successive estimates that have neighboring values, a quality factor being given to each estimate. The quality factor has a maximum value when the signal is perfectly periodic and a lower value when its periodicity is less pronounced. Since the voicing is directly related to the self-correlation of the speech signal for a delay equal to the value of the pitch chosen, the self-correlation is the maximum for a voiced sound while it is low for an unvoiced sound. The indication of the voicing is obtained by comparing the self-correlation with thresholds after temporal smoothing and hysteresis operations have been performed in order to prevent erroneous transitions from the voiced state to the unvoiced state and vice versa.

The method used for the determination of the pitches comprises two main processing steps, a pre-processing step represented by the flow chart of FIG. 1 and a self-correlation computation step. These two steps can easily be programmed on any known signal processor.

The pre-processing step can be divided in the manner shown in FIG. 1 into a self-adaptive filtering step 1 followed by a low-pass filtering step 2 and a self-adaptive clipping step 3.

In the self-adaptive filtration step 1, the sampled speech signal is first of all whitened by a self-adaptive filter of a order that is not too high, equal to 4 for example, for example so as to restrict the influence of the first formant. If S(n) represents the $n^{th}$ speech sample and $A_{i(n)}$ is the value of the $i^{th}$ coefficient, the signal Sb(n) obtained at the output of the self-adaptive filter is a signal having the form:

$$Sb(n)=S(n)-A_{1(n)}\cdot S(n-1)-A_{2(n)}\cdot S(n-2)-A_{3(n)}\cdot S(n-3)-A_{4(n)}\cdot S(n-4) \quad (1)$$

and the adaptation of the coefficients Ai(n) is obtained by the application of a relationship with the form:

$$Ai(n+1)=Ai(n)+\mathrm{Eps.Signe}(Sb(n)\times S(n-i))$$

where Eps is a low value constant equal, for example, to 1/128.

The signal $S_{b(n)}$ is then applied at the step 2 to the input of a low-pass filter, the role of which is only to keep only a minimum of harmonics of the fundamental frequency and, at the same time, to reduce the frequency band of the signal to then carry out a sub-sampling with the aim of reducing the time taken to carry out the self-correlation operations that shall be described hereinafter.

The filtered signal Sf(n) which is thus obtained may be expressed as an equation having the form $$Sf(n)=[Sb(n)+Sb(n-9)+3((Sb(n-1)+Sb(n-8))-+6(Sb(n-2)+Sb(n-7))+9(Sb(n-3)+Sb(n-6))-+11(Sb(n-4)+Sb(n-5))]\cdot/64 \quad (2)$$

or any other similar form capable of giving the low-pass filter a cut-off frequency of the order of 800 Hz, and a sufficient attenuation of the frequencies beyond 1,000 Hz.

The last pre-processing operation, which is performed in the step 3, converts the signal Sf(n) into a signal Scc(n) by a self-adaptive clippinq method of the type also known as "center clipping". Its effect is to reinforce the temporal differences of the filtered signal.

If, for example, the signal Sf(n) should contain very little fundamental component at a frequency $F_o$ and a great deal of harmonic 2 component, the waveform obtained at the end of the step 3 is then close to a sinusoidal form of a frequency 2. $F_o$ shows a slight distortion every two periods. This pre-processing operation of the step 3 then has the effect of further reinforcing this distortion to make the subsequent pitch computing operation easier. As shown in FIGS. 2A and 2B, this pre-processing operation consists in computing two adaptive thresholds, SfMin(n) and SfMax(n), that change in the course of time, to keep only the signal portions that are respectively below and above these two thresholds.

The thresholds SfMin(n) and SfMax(n) verify the relationships:

$$SfMin(n)=E\cdot SfMin(n-1) \quad (3)$$

$$SfMax(n)=E\cdot SfMax(n-1) \quad (4)$$

$$\text{with } E=\exp(-Te/Tau) \quad (5)$$

where Te is the sampling period and Tau is a time constant of the order of 5 to 10 ms.

It follows from the foregoing that the signal Scc(n) obtained at the end of the execution of step 3 always has a null amplitude except for:

$$SfMax(n)<Sf(n)<SfMin(n) \quad (6)$$

If Sf(n)>Sf(Max(n) then the difference Sf(n)−Sf(Max(n) is amplified to give a signal Scc(n) defined according to the relationship:

$$Scc(n)=G[Sf(n)-SfMax(n)] \quad (7)$$

In this case, the former value of SfMax(n) is updated by the new value of Sf(n) and SfMax(n) is made equal to Sf(n). By contrast, if Sf(n)<SmMin(n), it is the difference Sf(n)−SfMin(n) that is amplified to give a signal Scc(n) defined according to the relationship:

$$Scc(n)=G[Sf(n)-SfMin(n)] \quad (8)$$

and the former value of SfMin(n)=St(n) is updated by the new value of Sf(n).

In the relationships (7) and (8) G represents a value of gain that is preferably chosen to be constant in order to improve the computing precision should a signal processor working in fixed decimal mode be used.

If, in the previous relationships, the value of the time constant Tau is chosen to be null, it goes without saying that the signal Scc(n) is identical to the signal Sf(n).

The step of computing self-correlation that follows is done for each value M of the pitch for a determined sampling position No. In the following description, the computation has taken place by means of a sub-sampling of a factor 4 on a temporal range of 160 samples corresponding to a maximum value that may be accepted for the pitch. It is quite clear that the same principle can also be applied for a different sampling order and on a different range.

As shown in the steps 4 to 6 in the flow chart of FIG. 3, the computation operation consists in computing three quantities R00, RMM and ROM defined as follows, wherein the sign ** designates an exponentiation.

$$R00 = Scc(No)^{}2 + Scc(No + 4)^{}2 + Scc(No + 8)^{}2 + \ldots + Scc(No + 160)^{}2 \quad (9)$$

$$RMM = Scc(No - M)^{}2 + Scc(No + 4 - M)^{}2 + Scc(No + 8 - M) + \ldots + Scc(No + - 160 - M)^{**}2 \quad (10)$$

$$ROM = Scc(No)\cdot Scc(No - M) + Scc(No + 4)\cdot Scc(No + 4 - M) + \ldots + Scc(No + 1 - 60)\cdot Scc(No + 160 - M) \quad (11)$$

For each position No chosen, the quantity R00 is computed at the step 4 only once, the quantity RMM is computed integrally at the step 5 only for certain values of M and by iteration for the other values, and the quantity ROM is computed integrally at the step 5 for each value of M.

The values of M for which the self-correlation computation takes place correspond to a fundamental frequency of the speech signal capable of changing between 50 Hz and 400 Hz. These are determined on three ranges defined as follows:

Range 1 M=20, 21, 22 . . . 40 giving 21 values at the interval 1

Range 2 M=42, 44, 46 . . . 80 giving 20 values at the interval 1

Range 3 M=84, 88, 92 . . . 160 giving 20 values at the interval 1 giving a total of 61 different values that can be encoded for example on 6 bits with a minimum precision of 5% corresponding to a half-tone of the chromatic scale.

The iteration formula used for the RMM computation is the following:

$$RMM(M)=RMM(M-4)+Scc(No-M)^{}2-Scc(No+164-M)^{}2 \quad (12)$$

Besides, to improve the precision of searching for the maxima of self-correlation, a parabolic interpolation formula is used which, for a given value M, uses the values of the previous quantities for M−dM, M and M+dm, dM being an interval value equal to 1, 2 or 4 according to the range considered. The result thereof is that only the values of RMM (19), RMM (20), RMM (21), and RMM (22) have to be computed integrally. The others are computed by iteration, including for M=164.

As a function of the above, a value is computed: Rau(M) defined as follows:

Rau(M) = 0
if ROM(M) < = 0
and
Rau(M) = ROM(M)**2/[ROO(M) · RMM(M)]
if ROM(M) > 0

Only the values of M for which a local maximum is obtained, namely those for which Rau(M) verifies the inequalities:

$$Rau(M) > Rau(M-dM) \text{ et } Rau(M) >= Rau(M+dM)$$

are considered in the step 6. For these value of M only, there is then computed a value Rint interpolated parabolically according to the relationship $$Rint = Rau(M) + \tfrac{1}{2}[Rau(M+dM) - Rau(MdM)]^{**}2/[2.Rau(M) - Rau(M-dM) - Rau(M+dM)] \quad (13)$$

to keep, in the sequence of the processing operations, only the K values corresponding to the highest K values of Rint (and the associated values of M), for example the biggest K=2 maxima referenced Rmax(1), . . . , Rmax(K) (and Mmax(1), . . . , Mmax(K)).

The following part of the processing operation consists in keeping up to date a table of scores associated with the different possible values for the pitch M.

This table, referenced Score (i) in FIG. 4 contains, for the i=1 to 61 pitch values M, a quantity that is an increasing function of the degree of likelihood of the associated pitch (from 20 to 160) and is updated at each new evaluation of the self-correlations (typically every 5 to 10 ms), in taking account of the fact that, from one evaluation to the next one, the positions of the maxima may vary by more than one unit, remain stationary or vary by less than one unit depending on whether the pitch is respectively increasing, stationary or decreasing.

The table of the scores is transferred into a temporary table, marked ExScore(i) that is not shown. This table is defined as a function of the values of i as follows:

ExScore (0)=0
Exscore (i)=Score (i) for i=2
and Exscore (62)=0

Periodically (if not routinely), the minimum value is withdrawn to prevent possible overflows in such a way that:

$$ExScore(i) = ExScore(i) - ScoreMin \quad (14)$$

with $$ScoreMin = MIN[Score(20), Score(21), \ldots, Score(61)]$$

The different scores are initialized to take account of a possible drift of the pitch. This gives:

$$Score(i) = MAX[ExScore(i-1), ExScore(i), ExScore(i+1)]$$

for i=20, . . . , 61

Finally, for the values I(1), . . . , I(K) of i corresponding to the K pitches Mmax(1) . . . MMax(K) where maximum values are encountered, the scores are increased by a quantity equal to the maxima of the self-correlation found such that:

$$Score(I(K)) = Score(I(K)) + Rmax(K)$$

for k=1, 2, . . . , K.

and i=I(1), . . . , I(K)

Finally, the value M of the pitch chosen for the position No is the one corresponding to the maximum of the table of the scores, ScoreMax, located at the index Imax in this table.

If, for reasons of computing precision and/or algorithmic reasons, several successive values of the score are equal to the maximum ScoreMax, namely Score(Imax), Score(Imax+1), Score(Imax+dI), the value chosen for the pitch is the one that corresponds to Imax+[dI/2], [dI/2] being the integer value of the division dI by 2, as indicated in FIG. 4.

For a given frame, where the above-described computations are done several times, the final value of the pitch is that obtained in the last iteration, it being understood that there are between 2 and 4 iterations per frame.

The value M of the pitch which is thus obtained corresponds to the most likely periodicity of the speech signal centered around the position $N_o$ with a resolution of 1, 2 or 4 according to the range in which the value of M is located. The voicing rate is then computed by carrying out a self-correlation, standardized for a delay equal to M and possibly for neighboring values if the resolution is greater than 1, of the original speech signal S(n) and not on the pre-processed signal Scc(n) as for the computation of the pitch.

For example, for M=40, the standardized self-correlation is computed only for a delay of 30. For M=40, it is computed for delays of 40 and 41, and for M=100, it is computed for a delay of 100, but also for delays of 98, 99 as well as 101 and 102 (the resolution being 4 for M=100).

In every case, the chosen value Rm is the greatest of the values thus computed, an elementary value for M data elements being defined by the relationships:

$$R = ROM2/(R00 \cdot RMM) \text{ if ROM is positive}$$

or R=0 if ROM is smaller than or equal to zero $$Roo = S(N_o)^{}2 + S(N_o+1)^{}2 + \ldots + S(N_o+160)^{**}2$$

$$RMM = S(N_o - M)^{}2 + S(N_o + 1 - M)^{}2 + \ldots + S(N_o + 160 - M)^{**}2$$

$$ROM = S(N_o) \cdot S(N_o - M) + S(N_o + 1) \cdot S(N_o + 1 - M) + \ldots + S(N_o + 160) \cdot S(N_o + 160 - M)$$

Unlike the computation method implemented earlier to compute the signal $S_{cc}$ (n), the signal S(n) is not subsampled.

The quantity R00 does not depend on M and is computed only once. It is possible to limit the operation to computing RMM for the nominal value of M only, namely the value given by the method of computing the pitch as described here above. For values close to M it is possible to limit the operation to computing RMM by iteration if necessary. The quantity ROM should, on the contrary, be computed for each of the value of M.

To limit the fluctuations, especially in the noise-ridden environment of the quantity $R_m$ thus obtained, this quantity is filtered by a low-pass filter between two successive passages (corresponding to two successive values of the reference value $N_o$) to obtain a filtered value Rf(P) defined at each iteration p by the relationship:

$$Rf(P)=(1-a)\cdot Rf(P-1)+a\cdot R_m$$

where a is a constant preferably equal to $\frac{1}{4}$ or $\frac{1}{2}$ for the performance characteristics to be satisfactory.

By tolerating an encoding delay, an even more satisfactory expression may be the following:

$$-Rf(P)=[R_m(P-1)+2R_m(P)+R_m(P+1)]/4$$

Finally, the quantity Rf(P) is compared, as shown in FIG. 5, with two thresholds $S_V$ and $S_{NV}$, respectively called the voicing threshold and the non-voicing threshold such that the threshold $S_V$ is greater than the threshold $S_{NV}$ to obtain a binary indicator of voicing IV as shown in FIG. 5.

In FIG. 5, the state IV=1 corresponds to a voiced sound and the state IV=0 corresponds to an unvoiced sound.

Starting from the state IV=1, IV goes to the state 0 when Rf(P) becomes smaller than $S_{NV}$ and starting from the state IV=0, IV goes to the state 1 when Rf(P) becomes greater than $S_V$.

Typical values to adjust the two thresholds $S_{NV}$ and $S_V$ may be, for example, fixed at $S_V=0.2$ and $S_{NV}=0.05$ in taking 1 as the maximum value of Rf(P) and 0 as the minimum value of Rf(P).

In order to optimize the performance characteristics of the voicing decision, it is preferable for these thresholds to be adjustable to give a certain inertia to the decision which is not perceptible to the ear to prevent local errors in the appreciation of the voicing.

What is claimed is:

1. A method to evaluate a speech signal in vocoders with very low bit rates, including a first processing operation comprising the steps of:

cutting up, after sampling the speech signal into frames of a determined duration to obtain a sampled signal S(n);

first self-adaptive filtering of the sampled signal S(n) obtained in each of said frames to limit an influence of a first formant to obtain a first filtered signal;

second filtering of the first filtered signal to keep only a minimum of harmonics of a fundamental frequency to obtain a second filtered signal; and comparing the second filtered signal with two adaptive thresholds SfMin(n) and SfMax(n), respectively positive and negative and changing as a function of time according to a predetermined relationship, and obtaining third signal portions Scc(n) that are respectively above or below the two thresholds;

and including a second processing operation on the signal Scc(n) comprising the steps of:

computing, on a predetermined number of fundamental frequency values or M pitches, of a self-correlation of the signal Scc(n) obtained at the end of the first processing operation from a determined sampling instant No;

choosing from said M pitches or said fundamental frequency values, pitches or fundamental frequency values that are equal in number to a predetermined number n corresponding to a maxima of self-correlation; and entering values corresponding to said pitches or fundamental frequency values chosen in said choosing step in a table of scores updated at each new self-correlation so as to choose, as a pitch value, only a value that corresponds to a maximum score.

2. A method according to claim 1, wherein the computing step which performs a self-correlation of the signal Scc(n) is computed from a sampling instant No. on a determined number of samples that follows the signal Scc(n) by performing the steps of:

a first addition of a first sequence of said third signal portions Scc(n) separated from one another by a determined number of samples;

a second addition of a second sequence of samples each corresponding to a sample of the first sequence lagged by a delay of the value of the pitch M;

a third addition of products respectively of samples of the first sequence with the corresponding samples in the second sequence;

dividing a result of the third addition by a product of the first and the second additions, thereby obtaining a quotient; and;

determining a local maximum of the quotient.

3. A method according to claim 2, further comprising the step of:

low-pass filtering the values in the table; and comparing the low pass filtered values with hysteresis, with two thresholds, respectively voicing and non-voicing thresholds, to determine a state, voiced or unvoiced, of the speech signal.

4. A method according to claim 3, wherein the first self-adaptive filtering includes subtracting, from each current sample S(n), a sum weighted by coefficients Ai(n+1) of a determined number i of samples obtained at a previous point in time, the adapting of the coefficients Ai(n+1) being obtained by adding, to a current coefficient Ai(n), a constant having a sign equal to a sign of the first filtered signal multiplied with the sample S(n−i), thereby obtaining Ai(n+1).

5. A method according to claim 4, wherein the two adaptive thresholds SfMin(n) and SfMax(n) are determined for each current sample at the instant n from the previous sample of the instant n−1 by the relationships:

$$SfMin(n)=E\cdot SfMin(n-1)$$

$$SfMax(n)=E\cdot SfMax(n-1)$$

where E is an exponential function of the ratio between the period Te of the samples and a constant Tau with a value of 5 to 10 ms.

* * * * *